US005951349A

United States Patent [19]

Larose et al.

[11] Patent Number: 5,951,349

[45] Date of Patent: Sep. 14, 1999

[54] BACKLIT BUTTON/SWITCHPAD ASSEMBLY

[75] Inventors: Charles W. Larose, Kokomo; Robert Allan Pyburn, Carmel, both of Ind.

[73] Assignee: Delco Electronics Corporation, Kokomo, Ind.

[21] Appl. No.: 08/937,308

[22] Filed: Oct. 2, 1997

Related U.S. Application Data

[62] Division of application No. 08/684,784, Jul. 22, 1996, Pat. No. 5,718,326.

[51] Int. Cl.[6] ..... H01H 9/02

[52] U.S. Cl. ..... 445/22; 264/242; 264/272.11

[58] Field of Search ..... 445/22; 264/272.1, 264/272.11, 272.15, 242, 267

[56] References Cited

U.S. PATENT DOCUMENTS

| | | | |
|---|---|---|---|
| 4,459,256 | 7/1984 | Ziegler | 264/242 |
| 5,401,927 | 3/1995 | Lundell et al. | 200/314 |
| 5,416,144 | 5/1995 | Stein et al. | 524/188 |
| 5,477,430 | 12/1995 | LaRose | 362/84 |
| 5,510,782 | 4/1996 | Norris et al. | 341/22 |
| 5,512,718 | 4/1996 | LaRose | 200/314 |
| 5,679,304 | 10/1997 | Watanabe et al. | 264/242 |

FOREIGN PATENT DOCUMENTS

| | | | |
|---|---|---|---|
| 60930 | 3/1989 | Japan | 200/314 |

*Primary Examiner*—Kenneth J. Ramsey
*Attorney, Agent, or Firm*—Jimmy L. Funke

[57] ABSTRACT

A backlit button assembly suitable for use in an illuminated graphic display in an instrument panel of an automobile. The backlit assembly is composed of a support member and any number of molded plastic or silicone rubber buttons or keys that, together with the support member, form a keypad or switchpad. Each button of the assembly is injection molded to include a translucent portion that enables light to be transmitted from a backside of the button to a front surface of the button accessible to a person operating the button assembly. Each button is disposed at least partially within an opening formed in the support member, and has at least one integrally-formed hinge member that is directly adhered to the support member. The hinge member flexibly interconnects the button with the support member such that the button is flexibly supported within the opening in the support member.

8 Claims, 1 Drawing Sheet

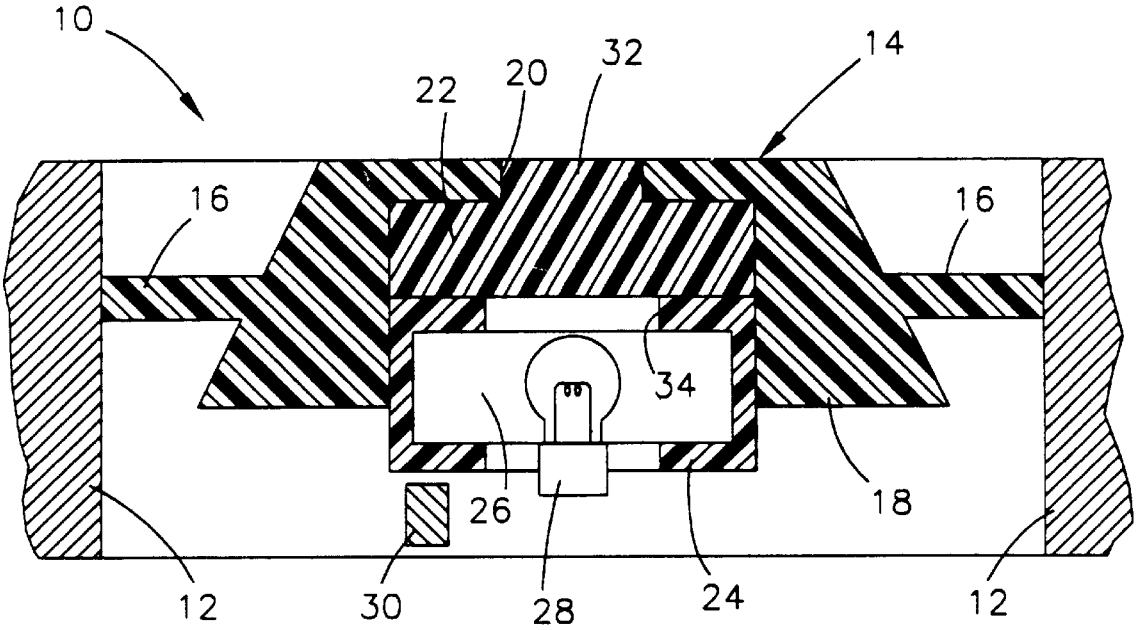
10
14
32
20
22
16
16
34
26
18
12
30
28
24
12

BACKLIT BUTTON/SWITCHPAD ASSEMBLY

This is a division of application Ser. No. 08/684784 filed on Jul. 22, 1996, now U.S. Pat. No. 5,718,326.

The present invention generally relates to backlit button and switchpad assemblies of the type used in the instrument panel of an automobile. More particularly, this invention relates to button and switchpad assemblies whose construction includes a two-shot liquid injection molded (LIM) silicone rubber body that forms a "soft-feel" backlit button, and which includes integrally-formed hinges that directly and adhesively attach and support the button to a surrounding support structure, such as a trimplate.

BACKGROUND OF THE INVENTION

Illuminated graphic button and switchpad assemblies are employed in automotive applications such as radios and environmental controls. Buttons for these assemblies often have backlit insignia which identify their particular functions. Such buttons are formed from a light-conducting material, i.e., a transparent or translucent material, which enables light to be transmitted through the button from the backside of the button to the insignia. A button and its insignia have been formed using paint and laser techniques or by injection molding. Paint and laser techniques generally involve the use of a transparent plastic substrate which may be painted white to form a white translucent layer over the substrate, and then painted black to form an opaque black covering over the substrate and, if present, the white translucent layer. The black covering is then lased away to form the insignia. The transparent nature of the substrate maximizes the transmission of light through the backlit component for night time viewing. If present, the white translucent layer contributes graphics whiteness by reflecting light, such that the insignia is more readily visible under natural lighting conditions during daylight hours. In contrast, buttons formed by liquid injection molding, or "LIM," entail the use of certain materials whose flow characteristics enable a two-shot molding process to form buttons having a light-conducting inner body and an outer opaque casing. A portion of the inner body is exposed through the casing after the molding operation, such that the casing delineates an insignia at the surface of the button.

Backlit buttons of the type described above must then be assembled in openings formed in a support panel, often referred to as a trimplate. The buttons are typically individually supported in a manner that permits their actuation within their respective openings, such that contacts located behind the buttons are closed in order to relay commands to the system controlled by the buttons. The components used to enable actuation of the buttons are typically formed separately from the buttons, necessitating their assembly with the buttons and the trim plate. To reduce complexity of the assembly process, these components are often mounted on a circuit board positioned directly behind the trimplate, on which the related circuitry is formed.

It is generally desirable to simplify and reduce the number of steps and components necessary to manufacture products, particular mass-produced products such as button and switchpad assemblies for the automotive industry. Therefore, it would be desirable if a backlit button assembly were available whose construction entailed fewer discrete components and enabled the elimination of certain assembly steps, resulting in a simplified and lower-cost assembly.

SUMMARY OF THE INVENTION

It is an object of this invention to provide a backlit button assembly composed of backlit buttons that are integrally molded with a trimplate by which the buttons are supported.

It is another object of this invention that such buttons have integrally-molded hinge portions that flexibly attach the buttons to the trimplate in order to enable the buttons to move relative to the trimplate.

It is still another object of this invention that the hinge portions directly adhere the buttons to the trimplate without supplemental adhesives.

It is a further object of this invention that such buttons can be molded with the trimplate using a two-shot injection molding technique that forms a backlit insignia on a surface of each button.

It is yet another object of this invention to provide a backlit component whose backlighting level and color can be readily tailored for a given application.

In accordance with a preferred embodiment of this invention, these and other objects and advantages are accomplished as follows.

According to the present invention, there is provided a backlit button assembly that is suitable for use in an illuminated graphic display in an instrument panel of an automobile. The backlit assembly is composed of a support member and any number of molded plastic buttons or keys that, together with the support member, form a keypad or switchpad. Each button of the assembly is injection molded to include a translucent portion that enables light to be transmitted from a backside of the button to a front surface of the button accessible to a person operating the button assembly. Each button is disposed at least partially within an opening formed in the support member, and has at least one integrally-formed hinge member directly and cohesively bonded to the support member. The hinge member flexibly interconnects the button with the support member such that the button is flexibly supported within the opening in the support member.

The transparent portion of each button is preferably formed by a light-conducting body that is disposed at least partially within the button. The color and backlighting intensity of each button can be readily tailored by admixing additives with the material forming the light-conducting body, so as to achieve a desired appearance and backlighting effect for the assembly's particular application. A portion of the light-conducting body is preferably exposed at the front surface of the button, so as to form an insignia that is visible to one operating the button assembly. In this manner, a light source disposed adjacent the light-conducting body causes light to be transmitted through the light-conducting body to the front surface of the button member via the insignia. The button can be molded to further incorporate a lightbox that houses the light source.

According to this invention, the button and its integrally-formed hinge member are formed from a material that is capable of cohesively bonding to the support member following the injection molding cycle, i.e., the hinge member direct adheres to the trimplate support member without the assistance of any additional adhesive materials. A suitable method for forming the backlit button assembly of this invention is a liquid injection molding (LIM) operation in which the support member, having one or more openings, is placed within a mold, and then an LIM material is injected into the mold to form a button that is disposed at least partially within one of the openings. As noted above, the molding operation results in the button having at least one integrally-formed hinge member that contacts the support member. As a result of the molding operation, the hinge member is cohesively bonded to the support member, such that the button member is flexibly attached to the support member and flexibly supported within the opening in the support member.

Inclusion of the light-conducting body described previously generally entails placing a preformed light-conducting body in the mold and within the opening in the support member prior to injection of the LIM material. The light-conducting body can also be formed from an LIM material, and the molding process is a two-step injection operation. The LIM material for the hinge member is then injected into the mold such that the button includes a casing at least partially surrounding the light-conducting body, and such that a portion of the light-conducting body is exposed through the casing at a surface of the button, thereby forming an insignia. The lightbox for the light source can be molded within the button by placing the lightbox within the mold such that the material for the casing and hinge member is injected around the lightbox and the light-conducting body is disposed between the lightbox and the surface of the button.

From the above, it can be appreciated that this invention eliminates the prior art requirement to assemble separately-formed buttons and actuation components with a support member to form a backlit button assembly. Accordingly, this invention provides a simplified manufacturing process that involves fewer processing and assembly steps, and therefore makes possible a less expensive manufacturing process.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing, in which is shown in cross-section a backlit button assembly configured in accordance with a preferred embodiment of this invention.

DETAILED DESCRIPTION OF THE INVENTION

The present invention is directed toward a backlit button or switchpad assembly, such as the assembly 10 shown in the Figure. The assembly 10 may be employed as the interior control for an instrument panel of an automobile, such as the controls for an automobile's radio or heating and air conditioning system. For illustrative purposes, the backlit assembly 10 is shown in the Figure as including a single button 14 and a single dedicated light source 28, though it is foreseeable that this invention could be practiced with a light pipe (not shown) that transmits light from a remote light source (not shown) to the button 14. Furthermore, those skilled in the art will recognize that the configuration shown in the Figure is merely one example of numerous possible arrangements, in which one or more backlit components are illuminated by one or more light sources, optionally in cooperation with one or more light pipes of any one of numerous designs and configurations. The specific characteristics of the light source 28 and any light pipe employed are not generally features of this invention, and the numerous possible variations in their design are generally within the knowledge and skill of those skilled in the art.

The button 14 is shown as being supported within an opening formed in a trimplate 12 in accordance with the teachings of this invention. As shown, the button 14 generally includes an outer casing 18, a translucent inner body 22, and a pair of hinges 16 that extend laterally from the casing 18 and directly attach the button 14 to a wall formed by the opening in the trimplate 12, as will be discussed in greater detail below. The casing 18 is preferably opaque, with a portion 32 of the inner body 22 being exposed at the front surface of the button 14. In this manner, light from the light source 28 is transmitted from the backside of the button 14, through the inner body 22 to the frontside of the button 14, with the visible portion 32 of the inner body 22 delineating an insignia 20 with the casing 18 at the front surface of the button 14.

As shown, the button 14 also includes a housing or lightbox 24 having a cavity 26 that houses the light source 28. An opening 34 in the lightbox 24 permits light from the light source 28 to directly illuminate the inner body 22. As such, the lightbox 24 can be formed of an opaque material, such as a suitable thermoplastic, though the lightbox 24 could alternatively be formed of a translucent material. If formed of an opaque material, the lightbox 24 is able to assist in reflecting and channeling light toward the inner body 22. Alternatively, if the lightbox 24 is formed from a clear thermostat (e.g., an LIM material), the exterior surface of the lightbox 24 can be textured such that light enters the lightbox 24 and is reflected off the textured surface, eventually being reflected through the inner body 22 toward the insignia 20. This latter approach enables the lightbox 24 and the inner body 22 to be manufactured simultaneously.

The assembly 10 is also shown as including a contact 30 located immediately below the lightbox 24. The contact 30 can be of any suitable type, such as a conductive pill or membrane switch, for closing an electrical circuit (not shown) associated with the button 14.

The trimplate 12 serves as a support member in which any number of buttons may be supported. The trimplate 12 may also include a display panel (not shown) through which information is conveyed to the user of the assembly 10 in any suitable manner, such as with a vacuum fluorescent (VF) display, a liquid crystal display (LCD) or light emitting diodes (LED) disposed behind a lens mounted to or in proximity to the trimplate 12. The trimplate 12 may be formed from various materials, with relatively low-weight, rigid materials such as nylon and polycarbonate being preferred in order to appropriately support an array of buttons.

According to this invention, the hinges 16 that attach the button 14 to the trimplate 12 are formed simultaneously with the casing 18, and cohesively bond to the surface of the trimplate 12 as a result of or following the molding operation by which the casing 18 and hinges 16 are formed. As such, the material for the hinges 16 and casing 18 and, the material for the trimplate 12 must achieve direct adhesion of the hinges 16 to the trimplate 12 without the assistance of additional adhesive materials. For this reason, the casing 18 and hinges 16 are formed from an elastically-deformable LIM material that enables the hinges 16 to cohesively bond to the trimplate 12 and form a sufficiently flexible joint between the button 14 and trimplate 12. While various LIM materials may be or become available to achieve this object of the invention, a preferred LIM material is an addition-curable platinum group metal-catalyzed silicone rubber disclosed in U.S. Pat. No. 5,416,144 to Stein et al., which is incorporated herein by reference. Commercial versions of this material are available from GE Silcones of Waterford, N.Y., under the names LIM8040A and LIM8040B. This LIM material is specially modified with one or more adhesion promoters that achieve the cohesion bonding properties required by this invention with a wide variety of materials, including metals and various plastics such as nylons and polycarbonates, which enables the trimplate 12, or at least the wall of the opening in the trimplate 12 to which the hinges 16 are bonded, to be formed from any one of these materials. This LIM material is also characterized by the ability to readily flow under practical injection molding conditions and temperatures, which promotes better definition of the insignia 20. The preferred LIM material is also tintable, and can be formulated to include density filters that modulate the amount of the light that can be transmitted through the casing 18 to achieve various levels of translucency, including opacity.

The translucent inner body 22 is preferably formed from an optically-clear silicone, including the LIM material preferred for the casing 18 and hinges 16 of the button 14. For purposes of this invention, the inner body 22 must be sufficiently translucent in order to have a suitable light transmission capability, such that light from the light source 28 is readily transmitted through the inner body 22 and emitted at a desired level through the insignia 20. Suitable materials for the inner body 22 are also preferably tintable and may include density filters that modulate the amount of the light that can be transmitted therethrough to the insignia 20.

A preferred method for forming the backlit assembly 10 of this invention involves conventional processing equipment, and includes a liquid injection molding operation to produce at least the casing 18 and hinges 16 of the button 14. The trimplate 12, inner body 22 and lightbox 24 are first placed within a suitable mold at a liquid injection molding station, with the inner body 22 and lightbox 24 being positioned relative to each other as shown in the Figure within the trimplate's opening. If formed from an LIM material, the inner body 22 is formed during a first liquid injection molding cycle, after which the button 14, defined by the casing 18 and the hinges 16, is molded with the trimplate 12 during a second injection molding cycle that simultaneously forms the backlit insignia 20 at the surface of the button 14. During the second injection molding cycle, the LIM material for the casing 18 and hinges 16 is injected into the mold such that the casing 18 surrounds the inner body 22 and lightbox 24, as depicted in the Figure. The LIM material is generally delivered as a two-component mixture to the molding station, and the mixture may be fed into a molding machine screw for further mixing, and thereafter transported and injected into the mold. During the second injection molding cycle, which may have a duration of about ten to fifteen seconds, the LIM material simultaneously molds and cures such that the required cohesive bonding occurs between the hinges 16 and the trimplate 12. Simultaneously, the casing cohesively bonds to the inner body 22 and lightbox 24, which avoids the requirement that the casing 18 must substantially or completely encase the inner body 22 and lightbox 24 in order to form an integral button 14.

The assembly 10 is then assembled with the remaining components, including a circuit board (not shown), required with the assembly 10 in order to form the desired display panel. At this assembly level, the light source 28 is inserted into the cavity 26 of the lightbox 24. Typically, the light source 28 is a bulb (as shown) mounted on the circuit board along with the contact 30 and other necessary switches, such that the light source 28 simply projects up into lightbox 24 as a result of assembling the circuit board with the assembly 10. Alternatively, the light source 28 could be located some distance away from the button 14, with a light pipe (not shown) positioned in proximity to the lightbox 24 to provide backlighting for the button 14.

From the above, it can be seen that an advantage of the present invention is that a separate step is not required to assembly the button 14 with the trimplate 12, because the molding operation results in the button 14 being directly and adhesively attached to the trimplate 12 through the hinges 16. Accordingly, this invention eliminates the requirement for various components conventionally required in the prior art to secure the button 14 within the assembly 10 and enable the button 14 to be actuated relative to the trimplate 12. As such, this invention enables display panels to be more readily and more efficiently mass-produced. This advantage of the invention becomes increasingly significant as the number of buttons 14 required by the assembly 10 increases.

In addition to the above, the materials and molding process of this invention enables the casing 18, hinges 16 and inner body 22 to be tailored to achieve a desired color and backlighting intensity for each individual button 14 and the assembly 10. The preferre LIM material is characterized by the ability to flow readily under typical injection molding conditions and temperatures, and thereby promotes better definition of the insignia 20.

While the invention has been described in terms of a preferred embodiment, it is apparent that other forms could be adopted by one skilled in the art. For example, processing methods other than those suggested here could be adopted, appropriate materials could be substituted for those disclosed, and the appearance of the assembly 10 and its components could differ significantly from that shown in the Figure. Accordingly, the scope of the invention is to be limited only by the following claims.

The embodiments of the invention in which an exclusive property or privilege is claimed are defined as follows:

1. A method for forming a backlit component, the method comprising the steps of:

placing within a mold a support member having an opening formed therein;

injecting an LIM material into the mold so as to form a button member disposed at least partially within the opening, the button member being formed to comprise at least one integrally-formed hinge member cohesively bonded to the support member, the hinge member flexibly interconnecting the button member with the support member such that the button member is flexibly supported within the opening.

2. A method as recited in claim 1 further comprising the step of placing a light-conducting body in the mold and within the opening in the support member prior to the injecting step, wherein the LIM material is injected into the mold such that the button member at least partially surrounds the light-conducting body, the button member being formed so as to have a surface through which a portion of the light-conducting body is exposed.

3. A method as recited in claim 2 further comprising the step of forming the light-conducting body in the mold by injecting an LIM material into the mold prior to the injecting step, whereby the method is a two-shot LIM process.

4. A method as recited in claim 2 further comprising the step of placing a light source adjacent the light-conducting body such that light is transmitted from the light source through the light-conducting body to the surface of the button member.

5. A method as recited in claim 2 further comprising the step of placing a lightbox within the mold such that the LIM material is injected around the lightbox and the light-conducting body is disposed between the lightbox and the surface of the button member.

6. A method as recited in claim 5 further comprising the step of placing a light source within the lightbox such that light is transmitted from the light source through the light-conducting body to the surface of the button member.

7. A method as recited in claim 1 wherein the LIM material is an addition-curable platinum group metal-catalyzed silicone rubber composition containing an adhesion promoter.

8. A backlit component formed by the method recited in claim 1.

* * * * *